United States Patent [19]

Feuillerat et al.

[11] Patent Number: 4,972,063

[45] Date of Patent: Nov. 20, 1990

[54] DEVICE FOR MOUNTING AND WITHDRAWING A PLASMA TORCH RELATIVE TO AN APPARATUS OPERATING UNDER PRESSURE AND TEMPERATURE PRECLUDING A DIRECT INTERVENTION

[75] Inventors: Jean Feuillerat; Jean Jouanno, all of Bordeaux, France

[73] Assignee: Aerospatiale Societe Nationale Industrielle, Paris, France

[21] Appl. No.: 412,799

[22] Filed: Sep. 26, 1989

[30] Foreign Application Priority Data

Oct. 3, 1988 [FR] France ..... 88 12898

[51] Int. Cl.[5] ..... B23K 9/00

[52] U.S. Cl. ..... 219/121.48; 219/121.51; 219/121.36; 219/121.37; 219/121.49; 373/18; 373/22; 373/24

[58] Field of Search ..... 219/121.49, 121.48, 219/121.36, 121.5, 121.51, 121.43, 75, 121.37; 373/22, 24, 18; 156/345; 75/10.19

[56] References Cited

U.S. PATENT DOCUMENTS

| | | | |
|---|---|---|---|
| 4,466,824 | 8/1984 | Gauvin et al. | 373/22 |
| 4,654,504 | 3/1987 | Sullivan et al. | 219/121.49 |
| 4,659,899 | 4/1987 | Welkie et al. | 219/121.49 |
| 4,761,793 | 8/1988 | Digne et al. | 219/121.5 |

*Primary Examiner*—M. H. Paschall

*Attorney, Agent, or Firm*—Martin Smolowitz

[57] ABSTRACT

The device for mounting and withdrawing a plasma torch in an apparatus at high pressure and temperature comprises in combination: at least one circular sealing element (2) interposed between the inner surface of a sleeve (3) and a nose (12) of the torch (4) and surrounding the nose, devices (6, 13) for balancing the pressures on each side of a valve (5) within the sleeve, and devices (18,23) for cooling the sealing element. The devices for balancing the pressures on each side of the valve comprise a communication pipe (6) by-passing the valve (5) and a tap valve (13) inserted in the pipe.

12 Claims, 3 Drawing Sheets

DEVICE FOR MOUNTING AND WITHDRAWING A PLASMA TORCH RELATIVE TO AN APPARATUS OPERATING UNDER PRESSURE AND TEMPERATURE PRECLUDING A DIRECT INTERVENTION

BACKGROUND OF THE INVENTION

The present invention generally relates to the use plasma torches in installations or apparatus operating under high temperature and high pressure conditions precluding any direct intervention for mounting or withdrawing the torch, and more particularily relates to a device for handling a plasma torch having a non-transferred arc in such an apparatus.

There is known a method described by the applicant in co-pending U.S. patent application Ser. No. 07/412,860 filed Sept. 26,1989 and entitled: "Method and device for mounting and withdrawing a plasma torch relative to an apparatus operating under pressure and temperature conditions precluding a direct intervention". In that method there is formed on the upstream side of a valve closing a sleeve for connecting the torch and, a sealed volume capable of varying. And the pressure prevailing in this volume is balanced with the pressure prevailing on the downstream side of the valve before opening the latter, for the purpose of mounting the nose of the torch in its operating position.

SUMMARY OF THE INVENTION

The object of the present invention is to provide another arrangement of a device for carrying out this method for mounting and withdrawing a pasma torch.

The invention provides for this purpose a device for mounting a plasma torch having a non-transferred arc on a sleeve having a closing valve and connected to an apparatus operating under high pressure and high temperature conditions, without modification of these conditions, and for withdrawing the torch, said device comprising in combination at least one circular sealing element interposed between the inner wall of the sleeve and the nose of the torch and surrounding the torch, means for balancing the pressures on each side of the closing valve, and means for cooling the sealing element.

According to another feature of the invention, said means for balancing the pressures on each side of the valve comprise a communication pipe by-passing the valve, and a tap inserted in said pipe.

According to one embodiment of the invention, said sealing element is mounted on the nose of the torch, in a peripheral groove.

In a variant embodiment, said sealing element is mounted in a peripheral groove of a circular cradle fitted around the nose of the torch. Advantageously, said cradle is formed by two parts which are axially interconncected and together define said groove.

In another embodiment, said cradle is fitted in a groove provided in the outer surface of the nose of the torch.

In another variant, said sealing element is disposed in a groove formed in the inner surface of the sleeve.

Said sealing element is preferably a metal element having a C-shaped section or a U-section auto-elastic sealing element.

In one example, the cooling means for the sealing element comprise a cooling fluid circulation circuit.

Advantageously, said circuit is that which ensures the cooling of the nose of the torch.

In another example, said circuit is constituted by a jacket surrounding the sleeve, at least in the region of the sealing element.

The following description, with reference to the accompanying drawings given by way of non-limitative examples, will explain how the invention may be carried out.

DESCRIPTION OF THE PREFERRED EMBODIMENTS

Figure 1:
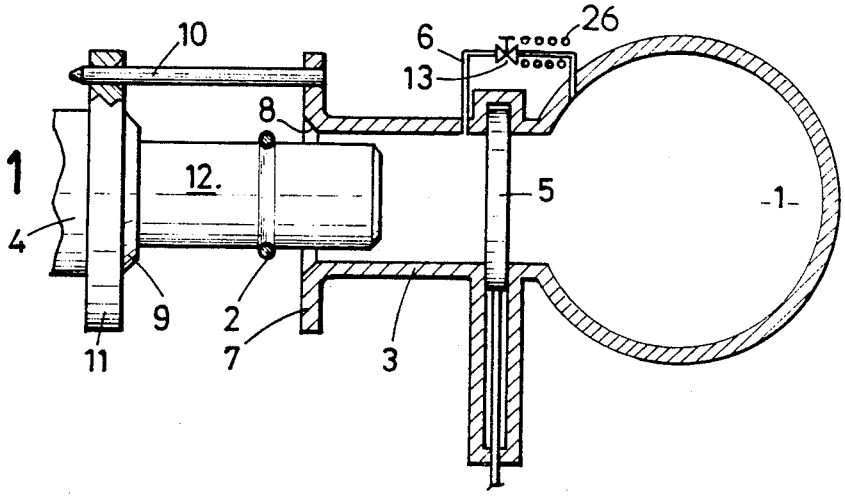
FIGS. 1, 2 and 3 are diagrammatic sectional views showing the stages for placing in position a plasma torch having a non-transferred arc, in a first embodiment of the device according to the invention.
Figure 2:
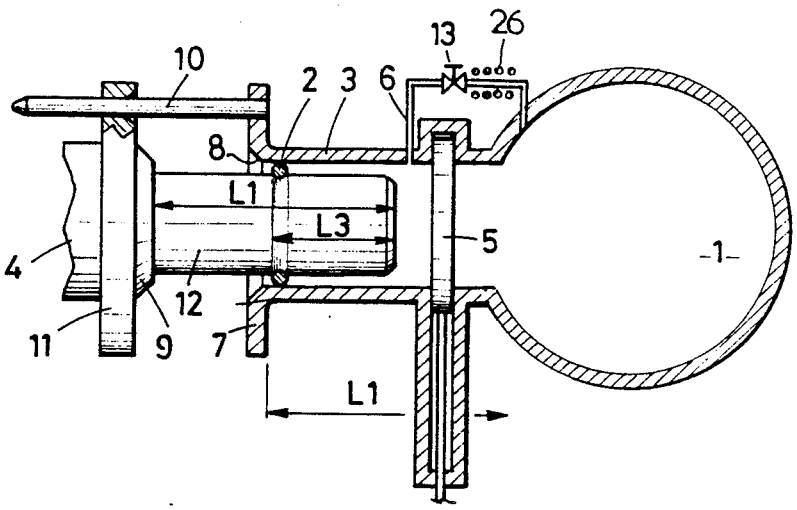
Figure 3:
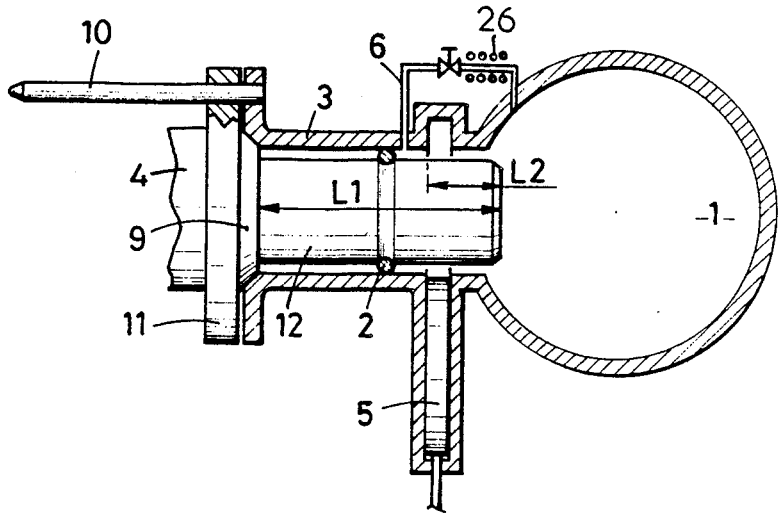

With reference to FIGS. 1 to 3, the reference numeral 1 designates a blast pipe of an apparatus, for example, a blast furnace, in which there is employed a plasma torch 4 of the non-transferred arc type and having a nose 12 engaged in one end of a sleeve 3 fixed at its opposite end to the blast pipe 1 and closed by a valve 5.

The sleeve 3 comprises a flange 7 having a chamfer 8 adapted to cooperate with a frustoconical centering surface 9 provided around the nose 12 of the torch 4.

A guide rod 10 is fixed to the flange 7 of the sleeve 3 and extends through an aperture provided in the flange 11 of the torch for guiding the torch in the direction toward the sleeve 3.

An O-ring sealing element 2 is mounted on the nose 12, which it surrounds in the manner described in more detail hereinafter.

A pipe 6 connects the upstream side of the valve 5 to the downstream side threof, the end of the torch 4 inserted in the sleeve being considered as the upstream end as opposed to the end of the sleeve adjacent to the blast pipe where the high pressure and high temperature conditions of operation of the apparatus prevail.

A tap 13 is inserted in the pipe 6 for controlling the putting of the upstream and downstream sides of the valve in communication with each other. Preferably, the tap 13 is protected against heating for example by a coiled tube 26 in which a cooling liquid circulates.

FIG. 1 shows the torch 4 in a position before it has been mounted and becomes operative, the valve 5 being closed and subjected on its downstream side to the pressure of the apparatus, the tap 13 being closed.

FIG. 2 shows the nose 12 of the torch engaged in the sleeve 3, the tap 13 and the valve 5 still being in their closed positions. In this position, the sealing element 2 is in sealing contact with the inner surface of the sleeve 3 and the nose 12 of the torch defines with the sealing element 2, the sleeve 3 and the valve 5 a sealed volume which varies as a function of the position of the nose 12 in sleeve 3. The tap 13 is then opened to bring this volume on the upstream side of the valve 5 to the same pressure as that prevailing on the downstream side. It then becomes possible to open the valve 5, whose opening was heretofore difficult owing the plasma conditions of $\Delta P$, and the torch 4 advanced to its mounted position of use represented in FIG. 3.

It can be seen, with reference to FIGS. 2 and 3, that the device can only operate under the condition of conforming to certain dimensional requirements, which are the following:

if L1 is the total length of the sleeve 3 and is equal to the length of the nose 12, if L2 is the distance between the nose 12 of the torch in the active position and the upstream plane of the valve 5, if L3 is the distance between the upstream plane of the sealing element 2 and the nose 12, L1 must be greater than L2 so that the sealing element is located on the upstream side of the valve 5 when the torch is in the active position, and L3 must be less than L1−L2 so as to form a sealed volume in the sleeve without the nose 12 abutting the closed valve 5 (FIGS. 2 and 3), and L1 must be greater than L2×2.

The various possible arrangements will now be described in more detail for mounting the sealing element 2 on the nose 12 of the torch 4, with reference to FIGS. 4 to 7 in which identical parts are designated by the same reference numerals.

Figure 4:
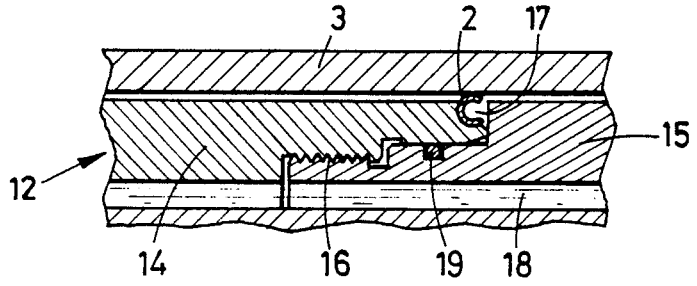
FIGS. 4 to 7 are partial sectional views of variants of the mounting of a sealing element according to the embodiment of FIGS. 1 to 3.

According to the embodiment of the partial view of FIG. 4, the reference numeral 3 designates the wall of the sleeve and the reference numeral 12 generally designates the nose of the torch 4.

The nose 12 is formed in two nose parts, namely an upstream part 14 and a downstream part 15 respectively fitted together, for example by screw threads 16 which are so arranged as to define therebetween a peripheral groove 17 forming a recess for the sealing element 2.

The nose 12 comprises in the known manner internally a cooling circuit in which circulates a cooling fluid designated by the reference numeral 18. This circuit is sealed by a sealing element 19 interposed between the parts 14 and 15.

Advantageously the sealing element 2 is composed of metal and has a C-shaped section. With this arrangement, the sealing element 2 is effectively, cooled by the cooling circuit of the nose of the torch 4.

Figure 5:
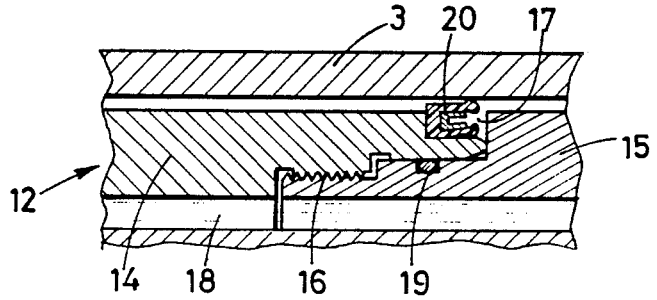

In the embodiment of the partial view of FIG. 5, the arrangement is identical to that of FIG. 4 except for the sealing element 20, which is of the so-called U-section autoelastic type comprising a metal core and an elastomeric coating, the wings of which are in contact with the parts between which it affords the seal.

Figure 6:
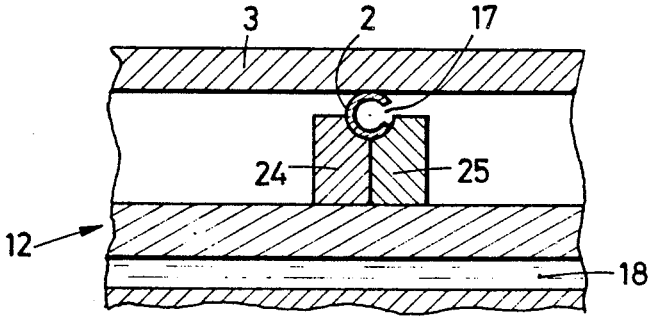

According to the embodiment of FIG. 6, the sealing element 2 is disposed in a recess 17 defined by two annular members 24, 25 fixed around the nose 12 by any suitable means, and in this way defining a gap between the nose of the torch and the sleeve 3. This arrangement also ensures a good thermal transfer between the nose and the sealing element and consequently a good cooling of the latter.

Figure 7:
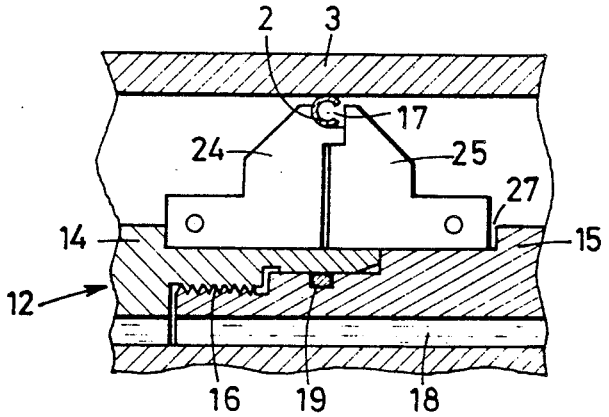

The arrangement of FIG. 7 is similar to the preceding arrangement, but the members supporting the sealing element 2 are mounted in a groove 27 defined between the parts 14 and 15 of the nose 12. This FIG. 7 arrangement provides a larger area of contact between the members 24 and 25 and the nose 12 which still further improves the thermal transfer therebetween.

Figure 8:
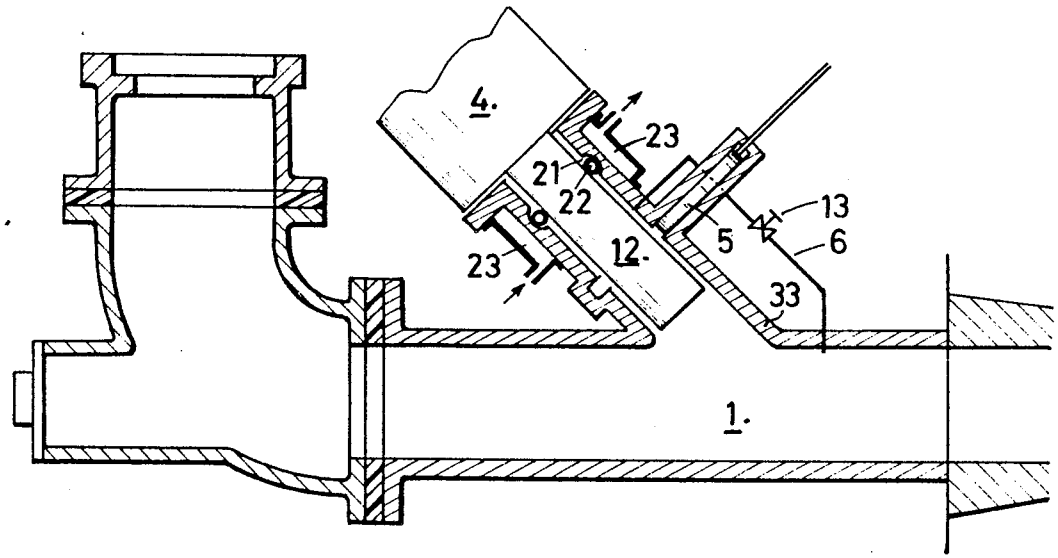
FIG. 8 is a sectional view of another embodiment of the invention.

FIG. 8 shows a variant in which the sealing element 22 is mounted in a groove 21 provided in the inner surface of the sleeve 33. In this embodiment, the sealing element 22 must be cooled through the sleeve by means of a jacket 23 which surrounds the latter and in which jacket a cooling fluid is made to circulate.

Although this FIG. 8 device also enables the aforementioned method for mounting and withdrawing a plasma torch 4 to be carried out, the maintenance or the changing of the sealing element 22 is difficult and requires a modification of the sleeve for cooling the sealing element. For these reasons, the solutions proposed in the embodiments of FIGS. 1 to 7 are preferred owing to the ease of access to the sealing element which permits its rapid replacement, each time the torch is used if desired.

What is claimed is:

1. A device adapted for mounting a plasma torch having a non-transfered arc and a nose, said torch being mounted on a sleeve comprising an inner surface and a closing valve and being connected to an apparatus operating under high pressure and high temperature conditions, without modification of said conditions, and adapted for withdrawing the torch from the apparatus, said device comprising in combination: at least one circular sealing element interposed between the inner surface of a sleeve of the apparatus and a nose of the torch and surrounding said nose, a closable valve provided within the sleeve; and means for balancing pressures on each side of the closable valve.

2. Device according to claim 1, wherein said means for balancing pressures comprise a communication pipe by-passing the valve, and a tap valve 13 inserted in the pipe, the pipe connecting an upstream side of the valve to a downstream side of the valve.

3. Device according to claim 1, comprising means defining a peripheral groove, the sealing element being mounted on the nose of the torch in said groove.

4. Device according to claim 3, comprising a circular cradle fitted around the nose of the torch and defining said peripheral groove.

5. Device according to claim 4, wherein said cradle comprises two cradle parts which are axially interconnected and together define said peripheral groove.

6. Device according to claim 5, wherein the nose of the torch defines an outer surface and a groove is provided in said outer surface of the nose, and said cradle is fitted in said groove provided in the outer surface of the nose.

7. Device according to claim 1, comprising a groove provided in the inner surface of the sleeve, said sealing element being disposed in said groove.

8. Device according to claim 2, wherein said sealing element is a metal sealing element having a C-shaped section.

9. Device according to claim 2, wherein said sealing element is a U-section auto-elastic sealing element.

10. Device according to claim 2, wherein the means for cooling the sealing element comprise a circuit and a cooling fluid circulating in said circuit, said circuit being a circuit for cooling the nose of the torch.

11. Device according to claim 7, wherein the means for cooling the sealing element comprise a jacket surrounding the sleeve and a cooling fluid circulating in said jacket.

12. A device according to claim 1, including means for cooling said sealing element.

* * * * *

UNITED STATES PATENT AND TRADEMARK OFFICE

CERTIFICATE OF CORRECTION

PATENT NO. :4,972,063

DATED :Nov. 20, 1990

INVENTOR(S) :Feuillerat et al.

It is certified that error appears in the above-identified patent and that said Letters Patent is hereby corrected as shown below: On the title page, in the heading:

Item [75] should read --Inventors: Jean Feuillerat; Jean Jouanno, both of Bordeaux, France; and Yves Herve Guillaume Valy of Issac, France--

Signed and Sealed this

Third Day of September, 1991

*Attest:*

HARRY F. MANBECK, JR.

*Attesting Officer*

*Commissioner of Patents and Trademarks*